US011740574B2

(12) United States Patent
Higashida et al.

(10) Patent No.: US 11,740,574 B2
(45) Date of Patent: Aug. 29, 2023

(54) LUBRICANT REPLACEMENT CASE

(71) Applicant: HEWLETT-PACKARD DEVELOPMENT COMPANY, L.P., Spring, TX (US)

(72) Inventors: Katsushi Higashida, Yokohama (JP); Takeshi Uchitani, Yokohama (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/672,105

(22) Filed: Feb. 15, 2022

(65) Prior Publication Data

US 2023/0049612 A1 Feb. 16, 2023

(30) Foreign Application Priority Data

Aug. 16, 2021 (JP) ..... 2021-132326

(51) Int. Cl.
*G03G 15/20* (2006.01)
*G03G 21/16* (2006.01)
*G03G 21/18* (2006.01)

(52) U.S. Cl.
CPC ..... *G03G 15/2025* (2013.01); *G03G 21/169* (2013.01); *G03G 21/1609* (2013.01); *G03G 21/1647* (2013.01); *G03G 21/1685* (2013.01); *G03G 21/1814* (2013.01); *G03G 21/1828* (2013.01); *G03G 2221/1606* (2013.01); *G03G 2221/1609* (2013.01); *G03G 2221/1669* (2013.01)

(58) Field of Classification Search
CPC ..... G03G 15/2025; G03G 21/1609; G03G 21/1647; G03G 21/1685; G03G 21/169; G03G 21/1814; G03G 21/1821; G03G 21/1828; G03G 2221/1606; G03G 2221/1609; G03G 2221/1669
See application file for complete search history.

(56) References Cited

U.S. PATENT DOCUMENTS

2006/0040195 A1* 2/2006 Miyakawa ..... G03G 9/09708 430/108.7
2008/0267666 A1* 10/2008 Shirokoshi ..... G03G 21/1647 399/222
2019/0025728 A1* 1/2019 Toba ..... G03G 15/0896

FOREIGN PATENT DOCUMENTS

JP 2012-58430 3/2012

* cited by examiner

*Primary Examiner* — Joseph S Wong
(74) *Attorney, Agent, or Firm* — Foley & Lardner LLP

(57) ABSTRACT

A lubricant replacement case for an image forming apparatus includes a housing including a plurality of storage compartments to accommodate at least one lubricant unit. The plurality of storage compartments include at least one storage compartment for unused lubricant to be inserted into the image forming apparatus and at least one storage compartment for used lubricant to be retrieved from the image forming apparatus.

20 Claims, 20 Drawing Sheets

LUBRICANT REPLACEMENT CASE

CROSS REFERENCE TO RELATED APPLICATIONS

This application claims the priority benefit from Japanese Patent Application No. 2021-132326 filed on Aug. 16, 2021, the contents of which are incorporated herein by reference.

BACKGROUND

An image forming apparatus includes a lubricant unit to lubricate an image carrier. In order to render the lubricant unit replaceable, the image carrier and the lubricant unit may be combined into a single unit that can be drawn out from the image forming apparatus.

DETAILED DESCRIPTION

An example lubricant replacement case for an image forming apparatus includes a housing including a plurality of storage compartments to accommodate at least one lubricant unit. The plurality of storage compartments include at least one storage compartment for unused lubricant to be inserted into the image forming apparatus and at least one storage compartment for used lubricant to be retrieved from the image forming apparatus. Since the lubricant replacement case includes the plurality of storage compartments to accommodate the at least one lubricant unit, a used lubricant unit can be retrieved from the image forming apparatus, and an unused lubricant unit can be inserted into the image forming apparatus.

Another example lubricant replacement case for an image forming apparatus includes a housing including a plurality of storage compartments to accommodate at least one lubricant unit. The housing has an opening adjacent to one of the plurality of storage compartments to accommodate the at least one lubricant unit. Since the lubricant replacement case includes the plurality of storage compartments to accommodate the at least one lubricant unit, and has the opening adjacent to the one of the plurality of storage compartments, a used lubricant unit can be retrieved from the image forming apparatus, and an unused lubricant unit can be inserted into the image forming apparatus. Accordingly, the scattering of toner, lubricant abrasive powder, or the like adhering to the lubricant unit can be suppressed when the lubricant unit is replaced.

In the following description, with reference to the drawings, the same reference numbers are assigned to the same components or to similar components having the same function, and overlapping description is omitted.

Figure 1:
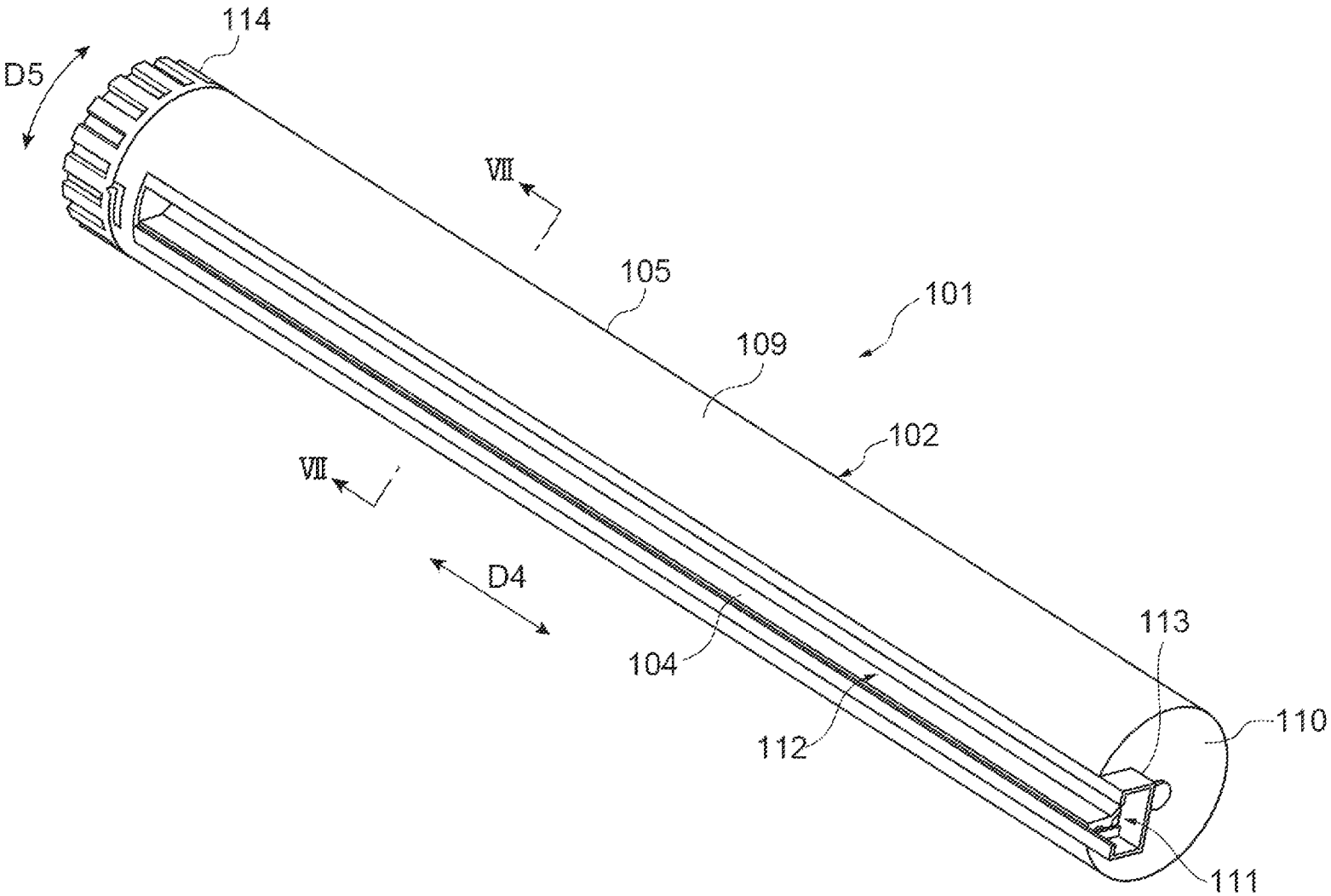
FIG. 1 is a perspective view illustrating an example lubricant replacement case.

FIG. 1 is a perspective view illustrating a lubricant replacement case 101 of an example. The example lubricant replacement case 101 is a case for an image forming apparatus. Namely, the lubricant replacement case 101 is a case to replace a lubricant unit of the image forming apparatus.

Figure 2:
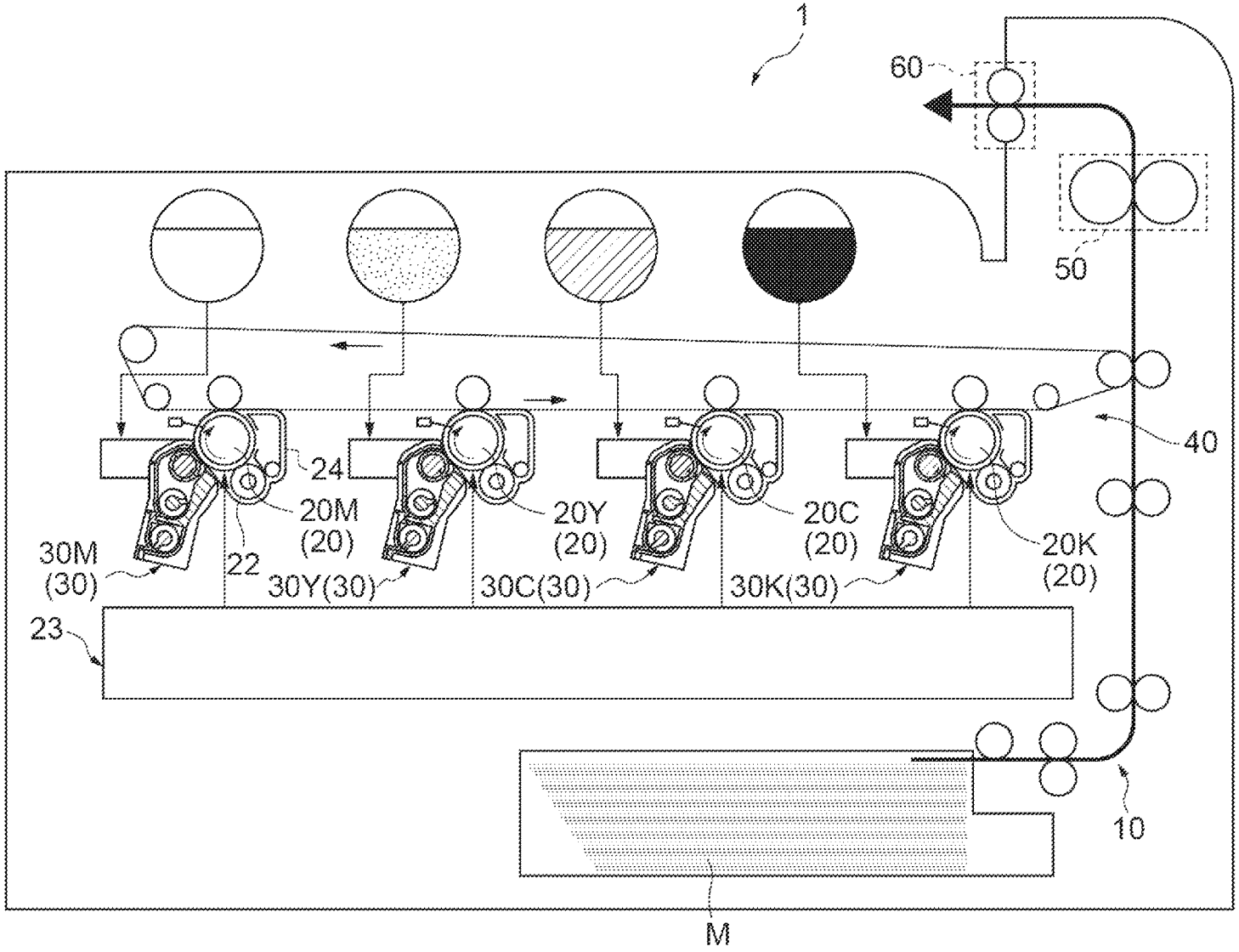
FIG. 2 is a schematic diagram of an example image forming apparatus.
Figure 3:
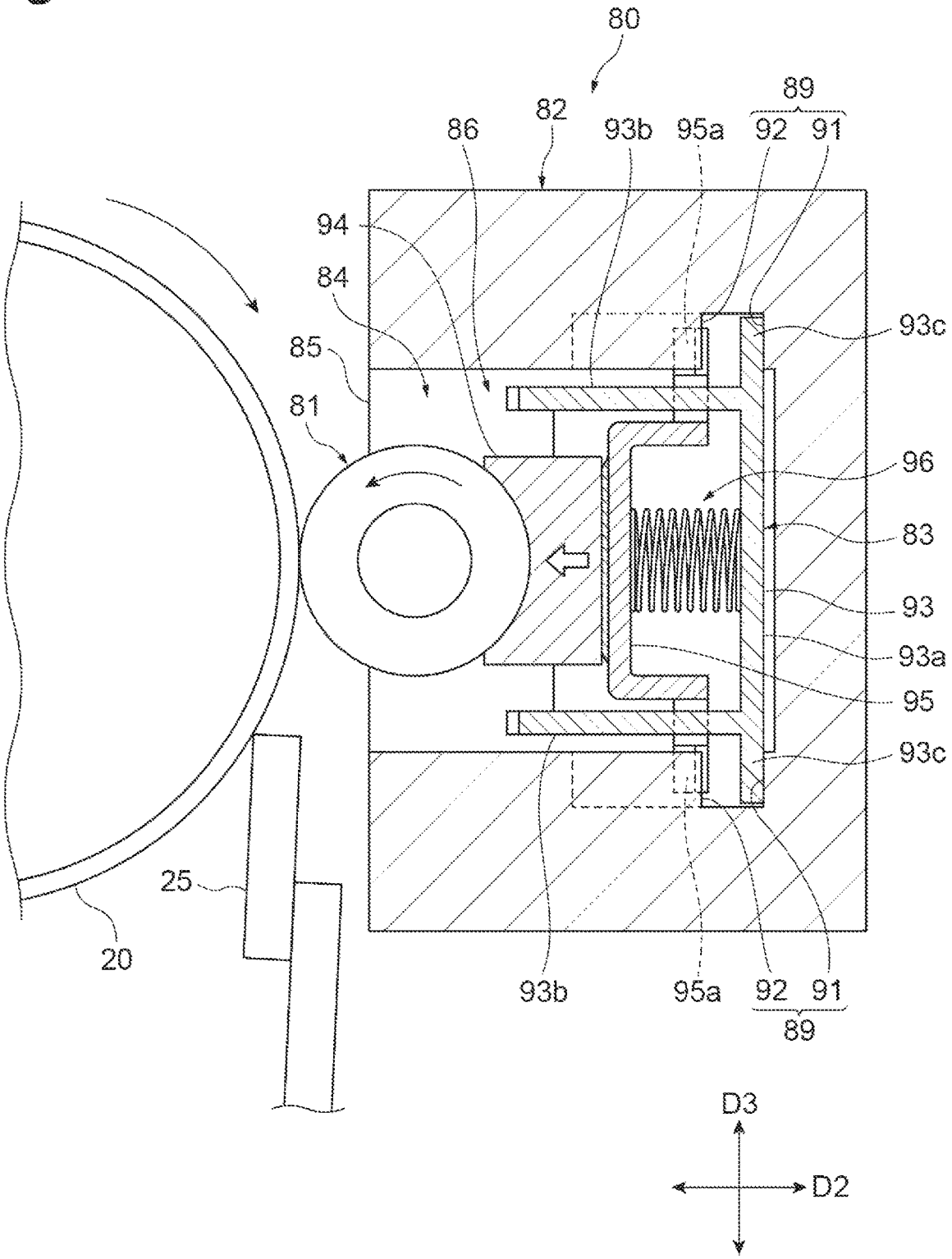
FIG. 3 is a cross-sectional view illustrating an example lubricant application device.
Figure 4:
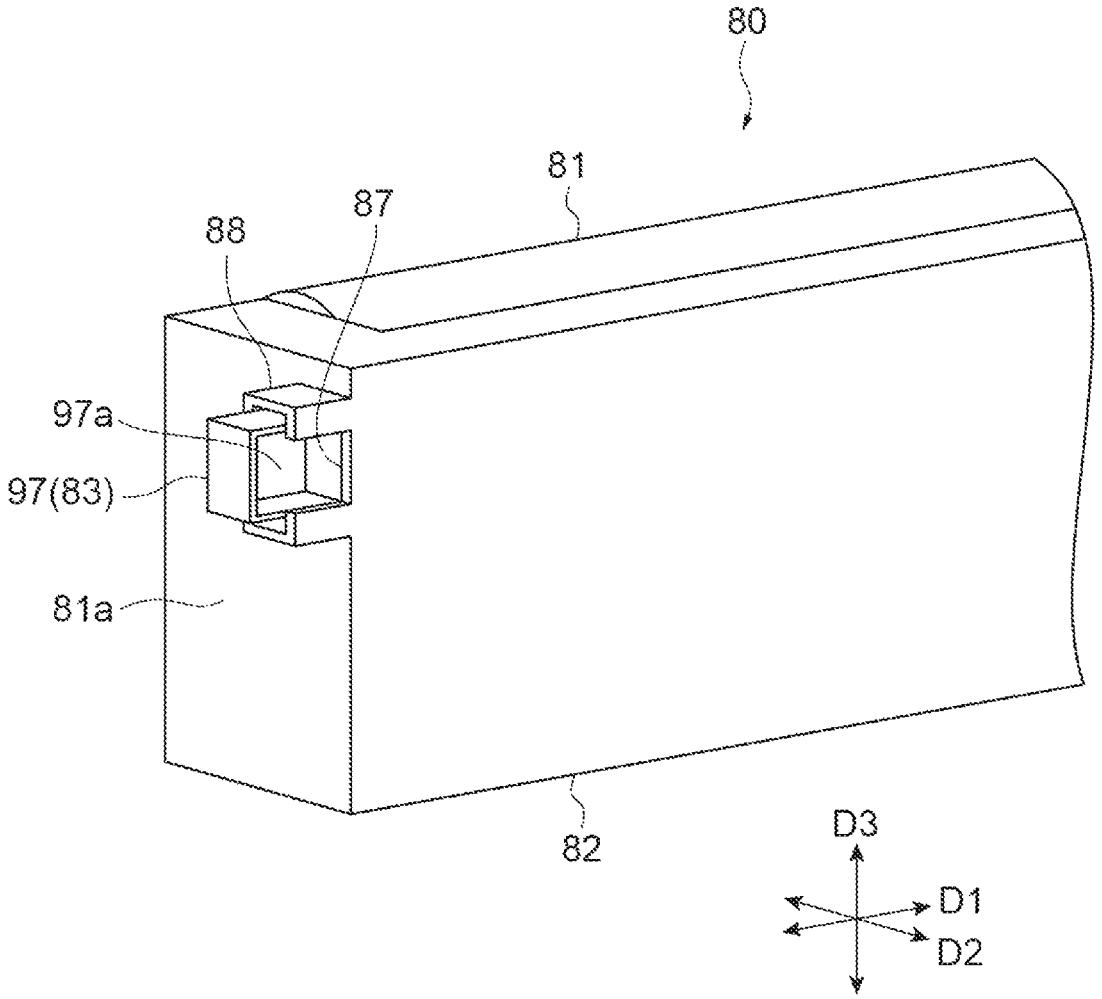
FIG. 4 is a perspective view illustrating a part of the example lubricant application device.
Figure 5:
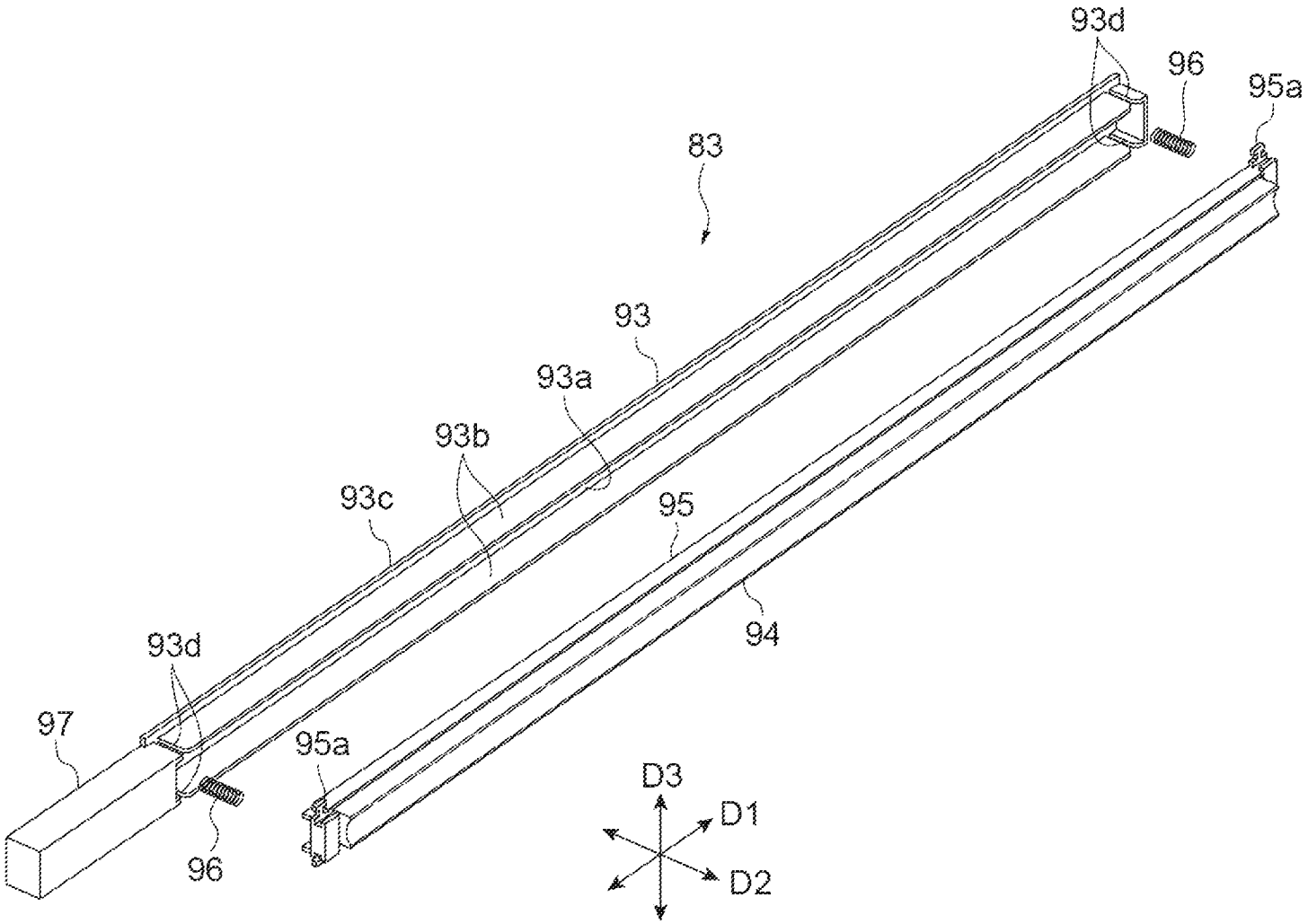
FIG. 5 is an exploded perspective view illustrating an example lubricant unit.

An example image forming apparatus and an example lubricant unit will be described with reference to FIGS. 2 to 5. FIG. 2 is a schematic view of the image forming apparatus of an example. FIG. 3 is a cross-sectional view illustrating a lubricant application device of an example. FIG. 4 is a perspective view illustrating a part of the example lubricant application device. FIG. 5 is an exploded perspective view illustrating a lubricant unit of an example.

With reference to FIG. 2, an example image forming apparatus 1 is an apparatus that uses toners of four colors such as magenta, yellow, cyan, and black to form a color image. The image forming apparatus 1 includes a conveying device 10, a plurality of image carriers 20, a plurality of developing devices 30, a transfer device 40, a fixing device 50, and a discharge device 60.

The conveying device 10 conveys a sheet (e.g., a sheet of paper) M that is a recording medium on which an image is to be formed. An electrostatic latent image is to be formed on a surface (peripheral surface) of each of the plurality of image carriers 20. The plurality of image carriers 20 include image carriers 20M, 20Y, 20C, and 20K. The image carriers 20M, 20Y, 20C, and 20K form electrostatic latent images to form magenta, yellow, cyan, and black toner images. Since the image carriers 20M, 20Y, 20C, and 20K have similar configurations, the image carriers 20M, 20Y, 20C, and 20K may be collectively described as the image carrier 20 unless otherwise specified.

The developing device 30, a charging roller 22, an exposure unit 23, and a cleaning unit 24 are provided on a periphery of the image carrier 20. The image carrier 20, the developing device 30, the charging roller 22, the exposure unit 23, and the cleaning unit 24 form an image carrier unit. The charging roller 22 charges the surface of the image carrier 20 to a predetermined electric potential. The exposure unit 23 exposes the surface of the image carrier 20, having been charged by the charging roller 22, to a light according to an image to be formed on the sheet M. The cleaning unit 24 retrieves a toner remaining on the image carrier 20. The cleaning unit 24 includes a cleaning blade 25 and a lubricant application device 80 (cf. FIGS. 3 and 4).

The plurality of developing devices 30 include developing devices 30M, 30Y, 30C, and 30K. The developing devices 30M, 30Y, 30C, and 30K are disposed on the peripheries of the image carriers 20M, 20Y, 20C, and 20K, respectively, to develop the electrostatic latent images formed on the respective surfaces of the image carriers 20M, 20Y, 20C, and 20K, so as to form respective toner images. Since the developing devices 30M, 30Y, 30C, and 30K have similar configuration, the developing devices 30M, 30Y, 30C, and 30K may be collectively described as the developing device 30 unless otherwise specified.

The transfer device 40 conveys the toner images, having been developed by the developing devices 30, and transfers the toner images onto the sheet M. When the sheet M passes through a fixing nip region where the sheet M is heated and pressed, the fixing device 50 fixes the toner images to the sheet M. The discharge device 60 discharges the sheet M, to which the toner images are fixed by the fixing device 50, to the outside of the apparatus.

With reference to FIGS. 3 and 4, the example lubricant application device 80 applies lubricant to the image carrier 20 to suppress abrasion of the image carrier 20 by the cleaning blade 25. The lubricant application device 80 includes an application roller 81, a housing 82, and a lubricant unit 83.

The application roller 81 extends in a longitudinal direction D1, and is adjacent to the image carrier 20 to contact the image carrier 20. The application roller 81 is supported so as to be rotatable around a central axis of the application roller 81. The application roller 81 is driven and rotated to apply the lubricant to the image carrier 20.

The housing 82 accommodates the application roller 81, and removably accommodates the lubricant unit 83. The housing 82 forms an application roller compartment 84, an application opening 85, a lubricant compartment 86, an opening 87, an apparatus side position guide 88, and a guiding rail 89.

The application roller compartment 84 forms a space to accommodate the application roller 81, and is positioned adjacent to the image carrier 20. The application opening 85 opens the application roller compartment 84 toward the image carrier 20. The application roller 81 protrudes from the application opening 85 to contact the image carrier 20. The lubricant compartment 86 forms a space to accommodate the lubricant unit 83, in which the lubricant unit 83 is slidable in the longitudinal direction D1, and is formed at a position that is adjacent to the application roller 81. The opening 87 is an opening at an end in the longitudinal direction D1 to install and remove the lubricant unit 83 into and from the housing 82. The opening 87 is formed in an end surface 82*a* in the longitudinal direction D1 of the housing 82 to open the lubricant compartment 86 to a longitudinal end of the lubricant application device 80.

The apparatus side position guide 88 is a portion to assist installation and removal of the lubricant unit 83 to and from the housing 82. The apparatus side position guide 88 protrudes from the end surface 82*a* of the housing 82 in the longitudinal direction D1. The apparatus side position guide 88 is formed to surround, for example, at least a part of the opening 87. The guiding rail 89 is a guide to slide the lubricant unit 83 in the longitudinal direction D1 so as to install and remove the lubricant unit 83 into and from the housing 82. The guiding rail 89 has a first guiding surface 91 extending in the longitudinal direction D1 and facing an application roller 81 side (so as to face the application roller 81), and a second guiding surface 92 extending in the longitudinal direction D1 and facing the first guiding surface 91.

With reference to FIGS. 3 and 5, the example lubricant unit 83 includes a frame 93, a solid lubricant 94, a support 95, a biasing member 96, and a grasping portion 97. Incidentally, hereinafter, unless otherwise specified, the directions relative to the lubricant unit 83 will be described with reference to a state where the lubricant unit 83 is set in the housing 82 of the lubricant application device 80.

The frame 93 is a member that contacts the first guiding surface 91 of the guiding rail 89, and that is slidable in the longitudinal direction D1 relative to the housing 82 of the lubricant application device 80. The frame 93 includes a base plate portion 93*a* extending in the longitudinal direction D1 so as to face the application roller 81, and a pair of side plate portions 93*b* extending from the base plate portion 93*a* toward the application roller 81, in a contact-and-separation direction D2 relative to the application roller 81.

The pair of side plate portions 93*b* extend from opposite ends of the base plate portion 93*a* in a short direction (e.g., height direction) D3 orthogonal to the longitudinal direction D1 and the contact-and-separation direction D2. Opposite ends 93*c* of the base plate portion 93*a* in the short direction D3 protrude from the pair of side plate portions 93*b*, so that the frame 93 contacts the first guiding surface 91 at the opposite ends 93*c* of the base plate portion 93*a*. Opposite ends of each of the pair of side plate portions 93*b* in the longitudinal direction D1 form slits 93*d*. Each of the slits 93*d* extends in the contact-and-separation direction D2, and is open to the application roller 81 side.

The solid lubricant 94 is a supply source of the lubricant, and is formed of a solid object of the lubricant. The solid lubricant 94 extends in the longitudinal direction D1 similarly to the application roller 81 to supply the lubricant to the application roller 81. The lubricant forming the solid lubricant 94 is made of, for example, a material containing zinc stearate.

The support 95 is disposed between the solid lubricant 94 and the frame 93 to support the solid lubricant 94. The support 95 extends in the longitudinal direction D1. The support 95 is longer than the solid lubricant 94, and protrudes from opposite ends of the solid lubricant 94 in the longitudinal direction D1. The solid lubricant 94 may be supported by the support 95, for example, by bonding using an adhesive.

The support 95 includes projections 95*a* that protrude from opposite ends of the support 95 in the longitudinal direction D1 to opposite sides in the short direction D3. A first pair of the projections 95*a* protrude from a first end of the support 95 in the longitudinal direction D1, to opposite sides in the short direction D3, and a second pair of the projections 95*a* protrude from a second end of the support 95 in the longitudinal direction D1 to the opposite sides in the short direction D3. The projections 95*a* are inserted into the slits 93*d* formed in the pair of side plate portions 93*b*, so as to be slidable in the contact-and-separation direction D2. The projections 95*a* are positioned to protrude relative to the pair of side plate portions 93*b* in the short direction D3, and the frame 93 contacts the second guiding surface 92 at the projections 95*a*.

The biasing member 96 is disposed between the base plate portion 93*a* of the frame 93 and the support 95 to bias the support 95 toward the application roller 81. Namely, the support 95 is biased away from the frame 93 by the biasing member 96. Since the biasing member 96 biases the support 95 toward the application roller 81, the solid lubricant 94 is biased (pressed) against the application roller 81. The biasing member 96 can be formed of, for example, a coil spring.

Then, since the opposite ends 93*c* of the frame 93 are guided by the first guiding surface 91, and the projections 95*a* of the support 95 are guided by the second guiding surface 92, the lubricant unit 83 is slidable in the longitudinal direction D1 relative to the housing 82, and can be inserted and removed into and from the opening 87. A part of the second guiding surface 92 is inclined in the contact-and-separation direction D2, so that when the lubricant unit 83 slides in the longitudinal direction D1 relative to the housing 82, a distance between the frame 93 and the support 95 in the contact-and-separation direction D2 varies.

The grasping portion 97 is a portion to insert and remove the lubricant unit 83 into and from the housing 82. The grasping portion 97 extends from the frame 93 in the longitudinal direction D1. The grasping portion 97 is formed so that at least a part of the grasping portion 97 protrudes from the opening 87 when the lubricant unit 83 is mounted on the frame 93. In addition, the grasping portion 97 forms a recess 97*a* that is to be hooked by a finger or the like to facilitate performing an operation of inserting and removing the lubricant unit 83 into and from the housing 82. The recess 97*a* is recessed in a direction intersecting the longitudinal direction D1.

Figure 6:
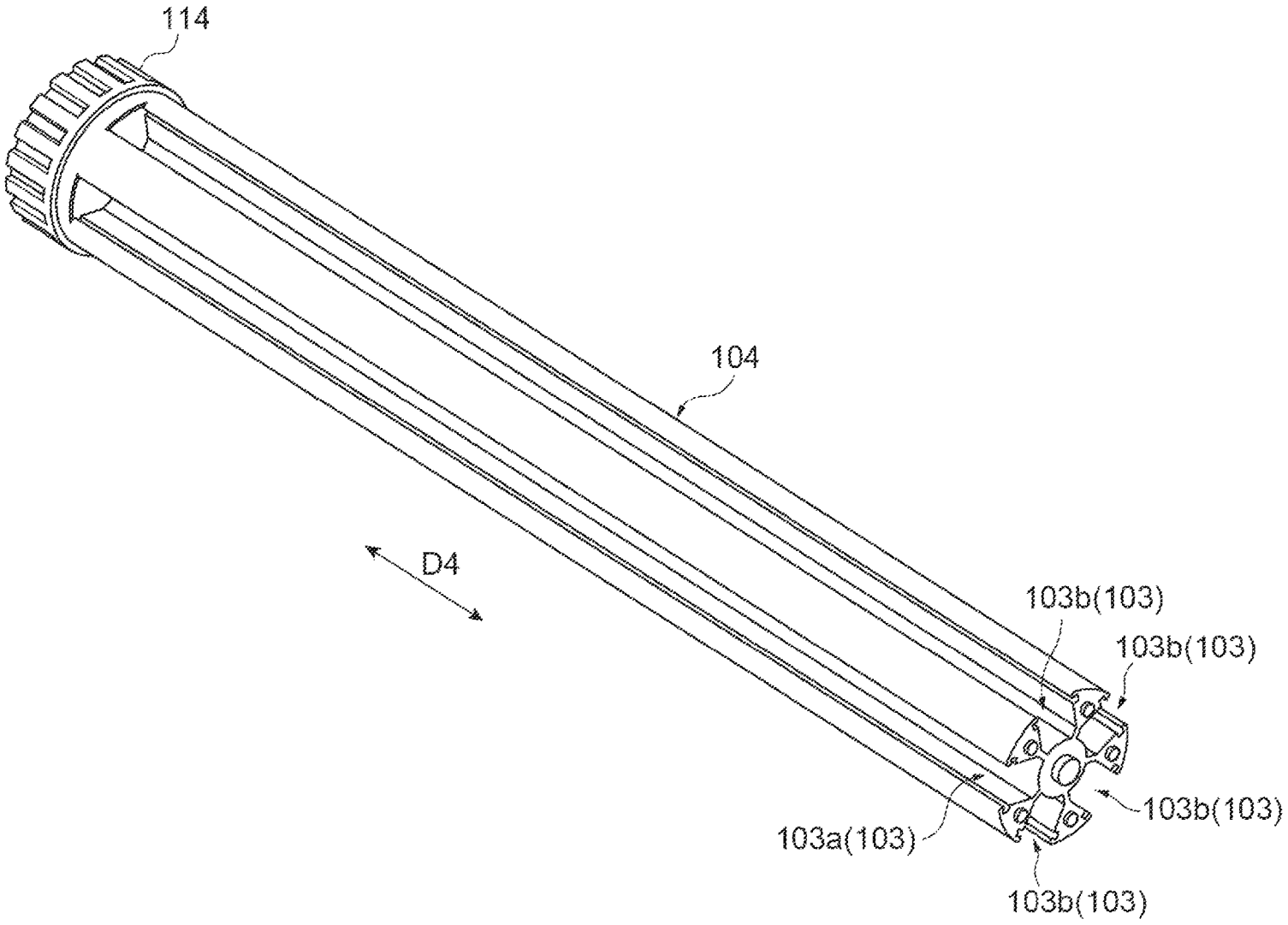
FIG. 6 is a perspective view illustrating a guiding support of the lubricant replacement case illustrated in FIG. 1.
Figure 7:
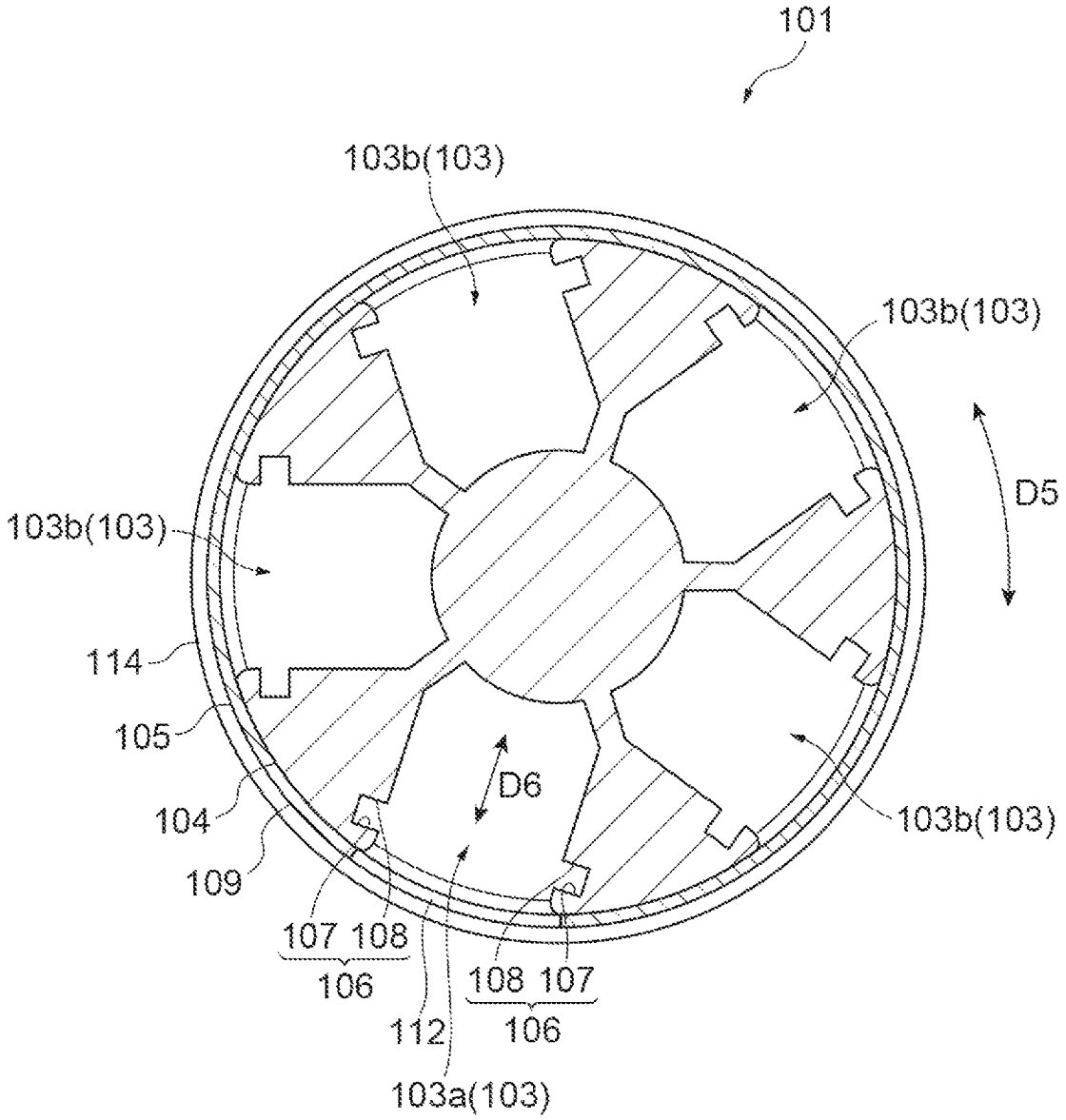
FIG. 7 is a cross-sectional view of the lubricant replacement case of FIG. 1, taken along line VII-VII.
Figure 8:
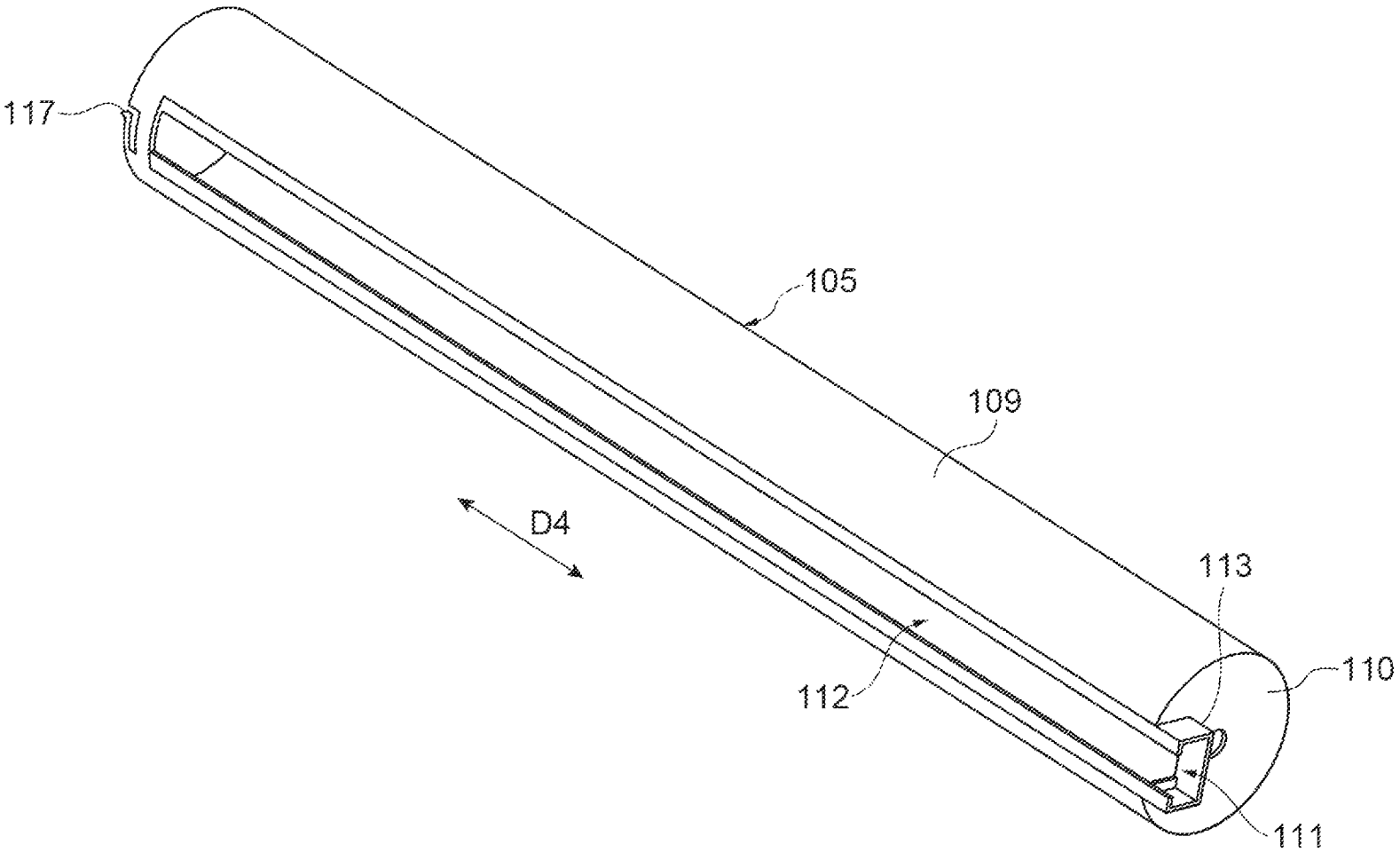
FIG. 8 is a perspective view illustrating an outer shell of the lubricant replacement case illustrated in FIG. 1.
Figure 9:
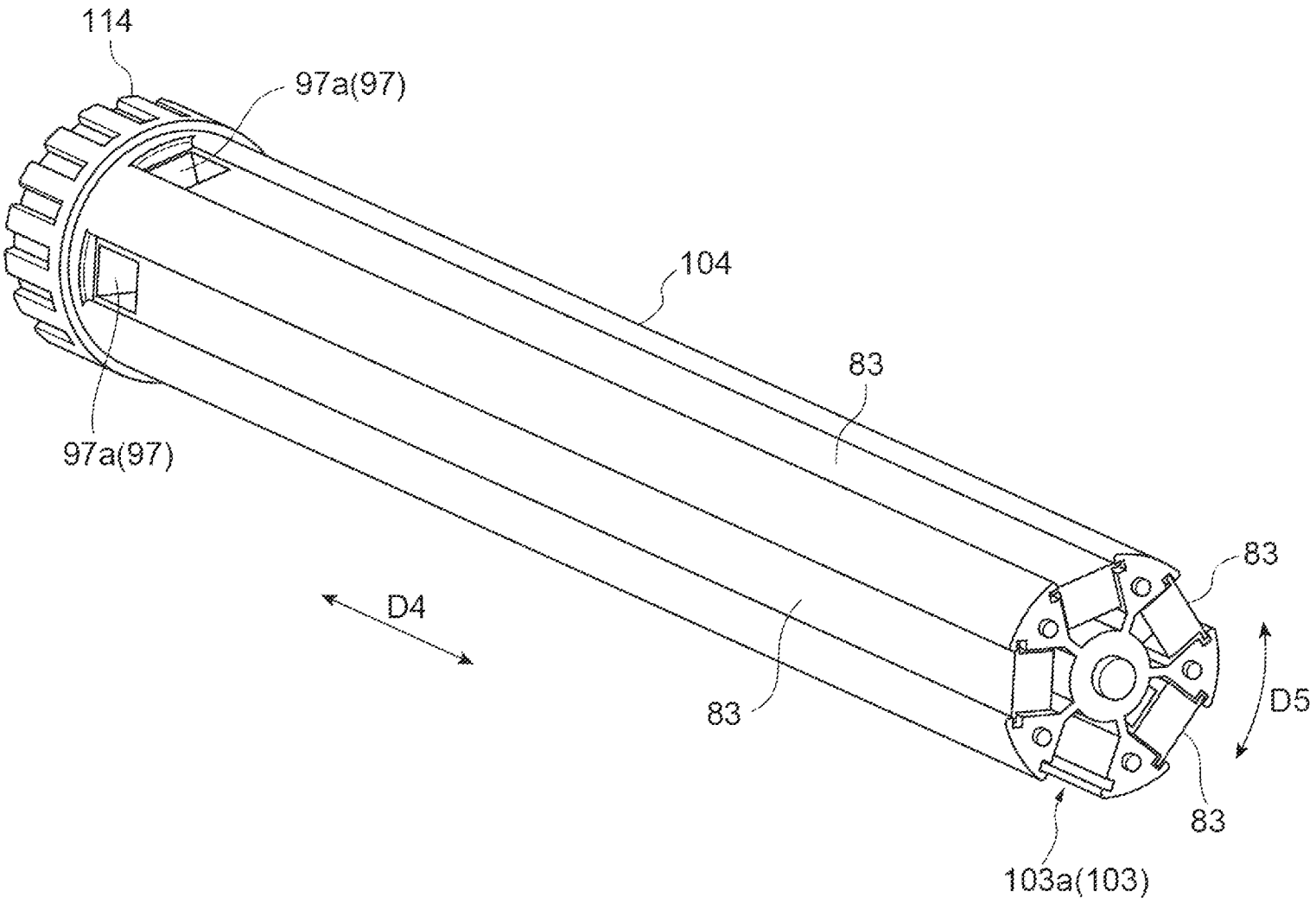
FIG. 9 is a perspective view of the example guiding support, illustrated in a state where a plurality of lubricant units are stored in the guiding support.
Figure 10:
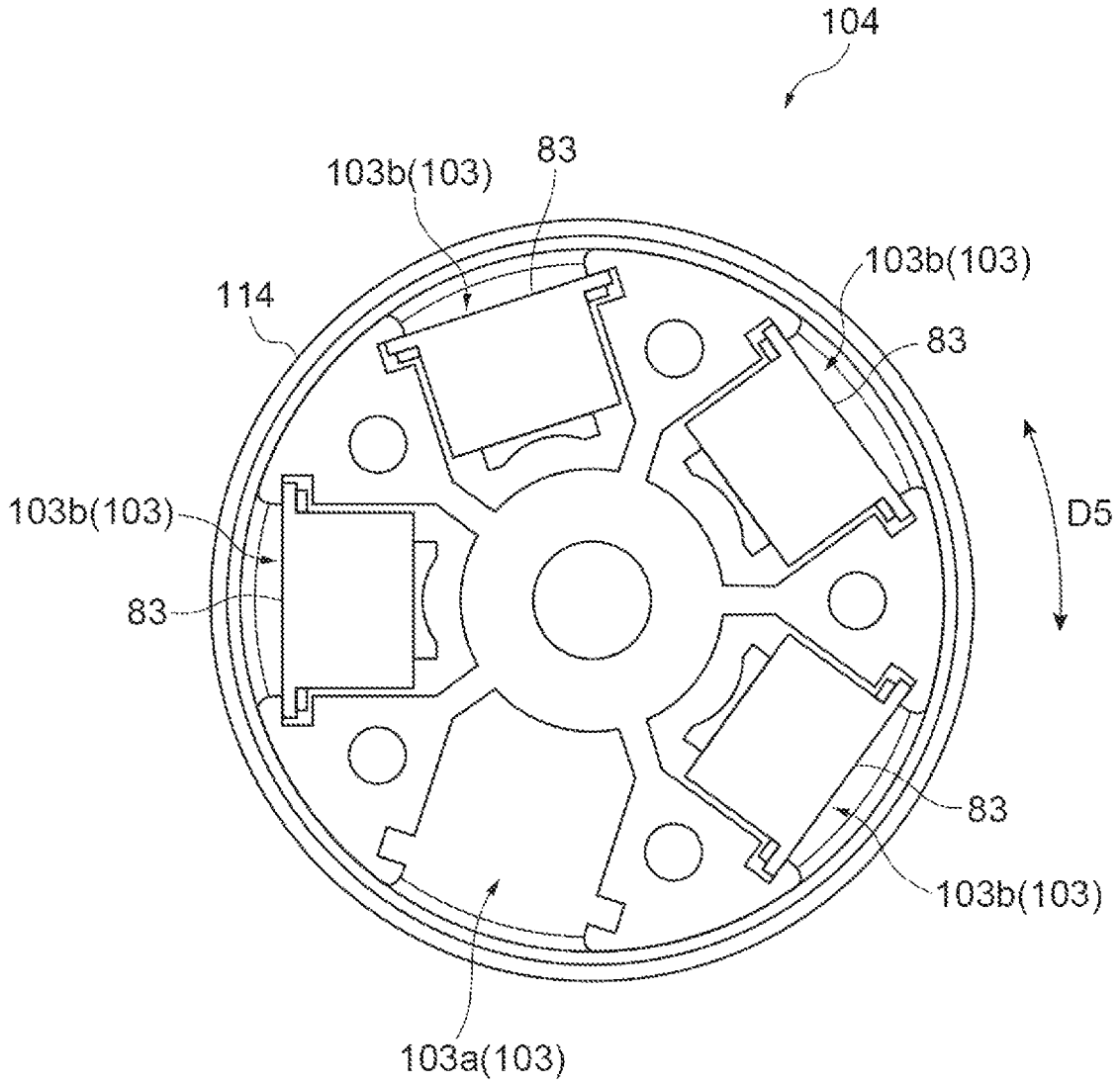
FIG. 10 is a side view of the guiding support illustrated in FIG. 9.
Figure 11:
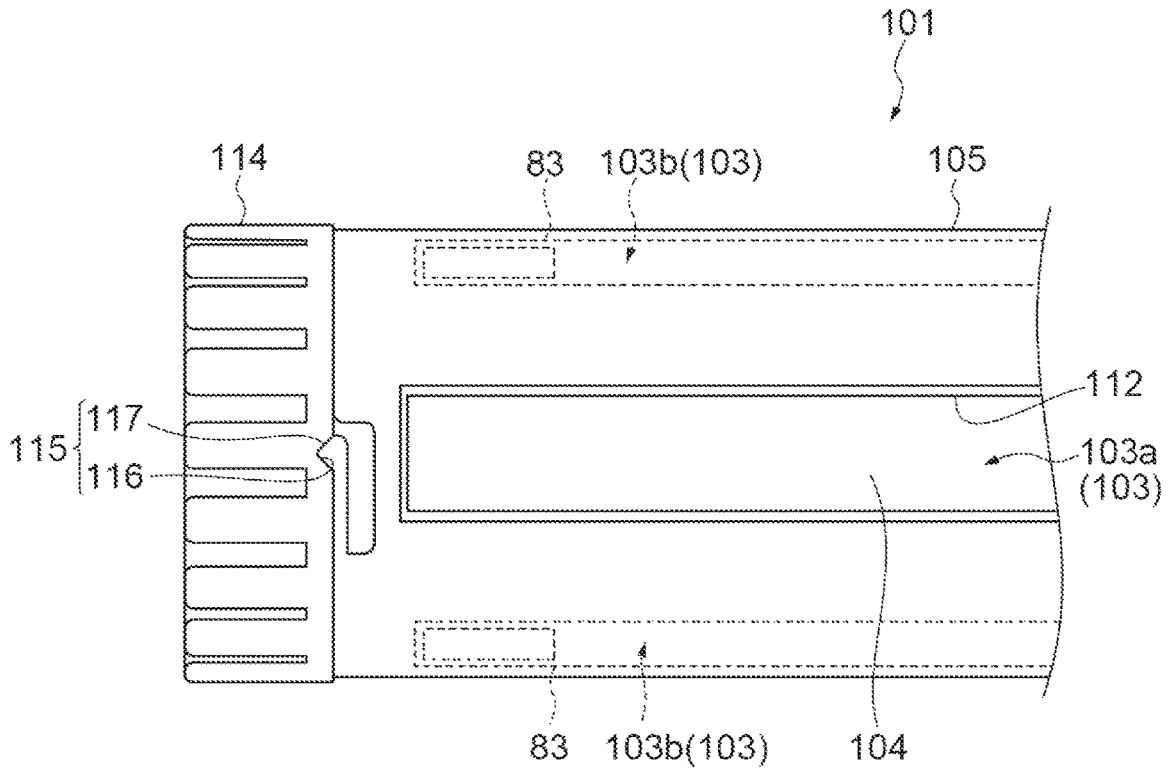
FIG. 11 is an enlarged front view of a part of the lubricant replacement case illustrated in FIG. 1.

FIG. 6 is a perspective view illustrating a guiding support of the lubricant replacement case illustrated in FIG. 1. FIG. 7 is a cross-sectional view taken along line VII-VII illustrated in FIG. 1. FIG. 8 is a perspective view illustrating an outer shell of the lubricant replacement case illustrated in FIG. 1. FIG. 9 is a perspective view illustrating a state where a plurality of lubricant units are stored in the guiding support illustrated in FIG. 1. FIG. 10 is a side view illustrating a state where the plurality of lubricant units are stored in the guiding support illustrated in FIG. 1. FIG. 11 is an enlarged front view of a part of the lubricant replacement case illustrated in FIG. 1. With reference to FIG. 1 and FIGS. 6 to 11, the example lubricant replacement case 101 includes a housing 102 including a plurality of storage compartments 103 to accommodate at least one lubricant unit 83. The housing 102 is formed in a substantially cylindrical shape. Each of the plurality of storage compartments 103 extends in a longitudinal direction D4. The plurality of storage compartments 103 may be isolated from each other in some examples, or in other examples, at least two of the plurality of storage compartments 103 may communicate with each other.

The plurality of storage compartments 103 include at least one storage compartment 103*a* (e.g., a first storage compartment) for a used lubricant unit 83 to be retrieved from the image forming apparatus 1, and at least one storage compartment 103*b* (e.g., a second storage compartment and additional storage compartments) for an unused lubricant unit 83 (e.g., for a replacement lubricant unit and additional replacement lubricant units) to be inserted into the image forming apparatus 1. For example, one unused lubricant unit 83 to be inserted into the image forming apparatus 1 is accommodated in each of the at least one storage compartment 103*b*. Since the example image forming apparatus 1 is provided with four lubricant application devices 80 corresponding to four image carriers 20M, 20Y, 20C, and 20K, an example guiding support 104 includes five storage compartments 103 including one storage compartment 103*a* and four storage compartments 103*b*. For example, the lubricant unit 83 is accommodated in each of the four storage compartments 103*b*.

The housing 102 includes the guiding support 104 forming the plurality of storage compartments 103 and an outer shell 105 covering the guiding support 104. The guiding support 104 is formed in a substantially cylindrical shape extending in the longitudinal direction D4, and the outer shell 105 is formed in a substantially cylindrical shape extending in the longitudinal direction D4. The guiding support 104 is rotatably coupled with the outer shell 105. Namely, the guiding support 104 is coupled with the outer shell 105 so as to be rotatable around a central axis of the guiding support 104.

The plurality of storage compartments 103 are arranged along an outer peripheral surface of the guiding support 104 in a rotational direction D5 of the outer shell 105 relative to the guiding support 104. Accordingly, the outer shell 105 is movable rotationally in an arrangement direction of the plurality of storage compartments 103 relative to the guiding support 104.

Each of the plurality of storage compartments 103 includes a guiding rail 106 to restrict a movement of the lubricant unit 83 accommodated in the storage compartment 103 in a transverse direction (or radial direction) D6 orthogonal to the longitudinal direction D4 (cf. FIG. 7). The transverse direction D6 is a radial direction of the housing 102. The guiding rails 106 are formed at opposite ends of each of the plurality of storage compartments 103 in the rotational direction D5 that is the arrangement direction of the plurality of storage compartments 103. The guiding rail 106 sets the support 95 of the lubricant unit 83 at a fixed position relative to the frame of the lubricant unit 83 accommodated in the storage compartment 103, to limit a movement of the lubricant unit 83 accommodated in the storage compartment 103 in the transverse direction D6.

The guiding rail 106 has a first guiding surface 107 extending in the longitudinal direction D4 and oriented to face substantially toward a center of the housing 102 in the transverse direction D6, and a second guiding surface 108 extending in the longitudinal direction D4 and facing the first guiding surface 107 in the transverse direction D6. Accordingly, the first guiding surface 107 and the second guiding surface 108 face each other in the transverse direction D6. The first guiding surface 107 is formed at a position to contact the opposite ends 93*c* of the frame 93 of the lubricant unit 83 to be accommodated in the storage compartment 103. The second guiding surface 108 is formed at a position to contact the projections 95*a* of the support 95 of the lubricant unit 83 to be accommodated in the storage compartment 103. Accordingly, the first guiding surface 107 and the second guiding surface 108 of the guiding rail 106 interpose the opposite ends 93*c* of the frame 93 and the projections 95*a* of the support 95 in the transverse direction D6. Accordingly, the support 95 is set at the fixed position relative to the frame of the lubricant unit 83 accommodated in the storage compartment 103, so that a movement of the lubricant unit 83 accommodated in the storage compartment 103 in the transverse direction D6 is restricted.

The outer shell 105 includes a side cover 109 extending in a cylindrical shape and covering a side portion of the guiding support 104, and an end cover 110 covering an end (longitudinal end) of the guiding support 104 in the longitudinal direction D4. The end cover 110 forms an opening 111 to slide the lubricant unit 83 into one of the plurality of storage compartments 103 in the longitudinal direction D4. The side cover 109 forms a slit 112 extending in the longitudinal direction D4 at a position that is aligned with the opening 111, so as to slide the lubricant unit 83 into one of the plurality of storage compartments 103 in the longitudinal direction D4. The slit 112 is adjacent to the opening 111 in the longitudinal direction D4, and is connected to the opening 111. When the guiding support 104 is rotated in the rotational direction D5 relative to the outer shell 105, the opening 111 and the slit 112 can be aligned with any one of the plurality of storage compartments 103.

Each of the plurality of storage compartments 103 is open from the guiding support 104 in the transverse direction D6 so that any one of the plurality of storage compartments 103 is exposed from the slit 112 of the outer shell 105. In addition, each of the plurality of storage compartments 103 is open from the guiding support 104 to one end in the longitudinal direction D4 so that any one of the plurality of storage compartments 103 is exposed from the opening 111 of the outer shell 105.

The end cover 110 of the outer shell 105 includes a position guide 113. The position guide 113 positions the opening 111 adjacent to the lubricant compartment 86 and the opening 87 of the lubricant application device 80 so as to move at least one lubricant unit 83 between the lubricant replacement case 101 and the image forming apparatus 1 in the longitudinal direction D4. The position guide 113 protrudes from the end cover 110 in the longitudinal direction D4 to fit onto the apparatus side position guide 88 of the lubricant application device 80. The position guide 113 is formed to surround, for example, at least a part of the opening 111.

The outer shell 105 is open at a distal end opposite the end cover 110 in the longitudinal direction D4. The guiding support 104 includes a rotational operation portion 114 that extends from the open end of the outer shell 105 to rotate the guiding support 104 in the rotational direction D5 relative to the outer shell 105. An outer peripheral surface of the rotational operation portion 114 forms a plurality of ribs to facilitate gripping the guiding support 104 for rotation.

The housing 102 includes a click stop coupling 115. The click stop coupling 115 positions the outer shell 105 relative to the guiding support 104 so that the opening 111 is aligned with one of the plurality of storage compartments 103. Namely, the guiding support 104 and the outer shell 105 are positioned by the click stop coupling 115 so that the opening 111 is aligned with one of the plurality of storage compartments 103.

The click stop coupling 115 includes, for example, a recess 116 for each of the plurality of storage compartments 103 and a biased projection 117 to releasably fit into the recess 116. The recess 116 is formed in, for example, the rotational operation portion 114 of the guiding support 104, and the biased projection 117 is formed in, for example, the side cover 109 of the outer shell 105. The recess 116 and the biased projection 117 are V-shaped, for example, having a shape that is inclined to opposite sides in the rotational direction D5, so that the guiding support 104 is rotatable in opposite directions of the rotational direction D5 relative to the outer shell 105.

Figure 12:
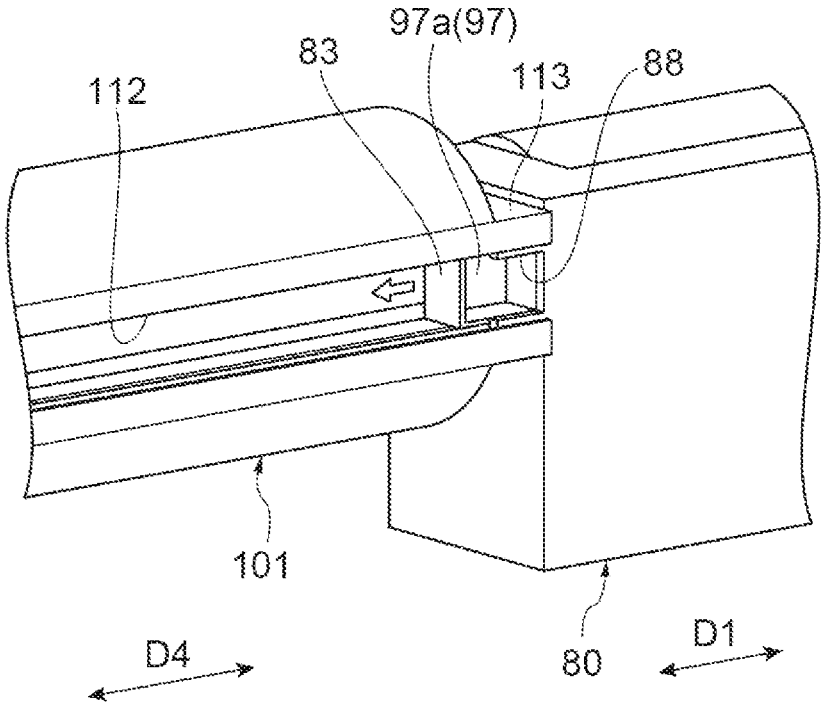
FIG. 12 is a perspective view of a portion of the lubricant replacement case illustrated adjacent a portion of a lubricant application device in a retrieval operation of a used lubricant unit.
Figure 13:
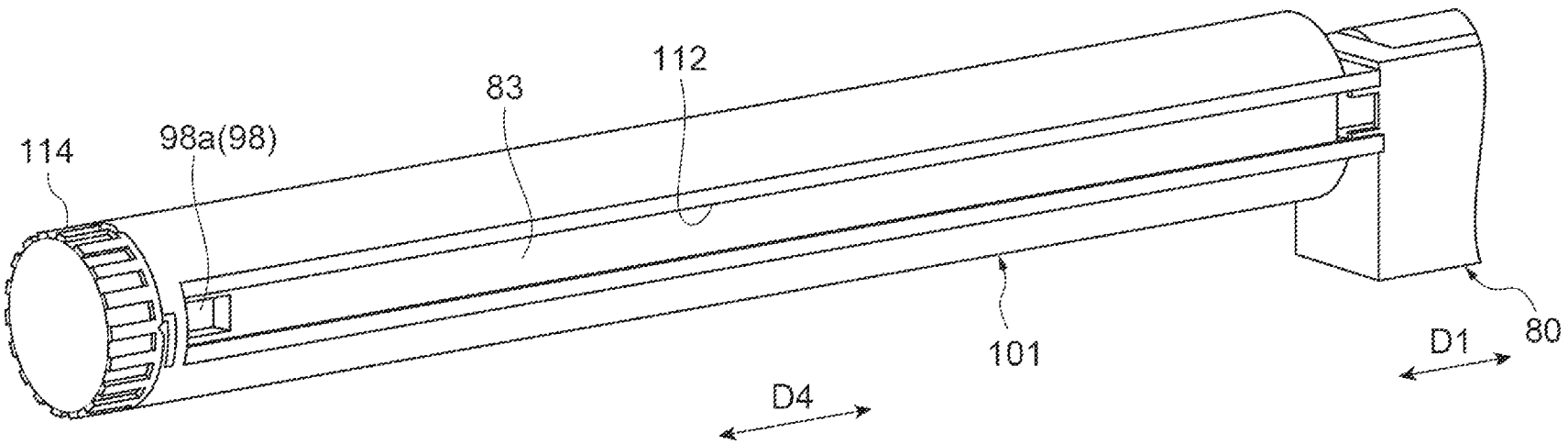
FIG. 13 is another perspective view of the example lubricant replacement case in the retrieval operation of the used lubricant unit.
Figure 14:
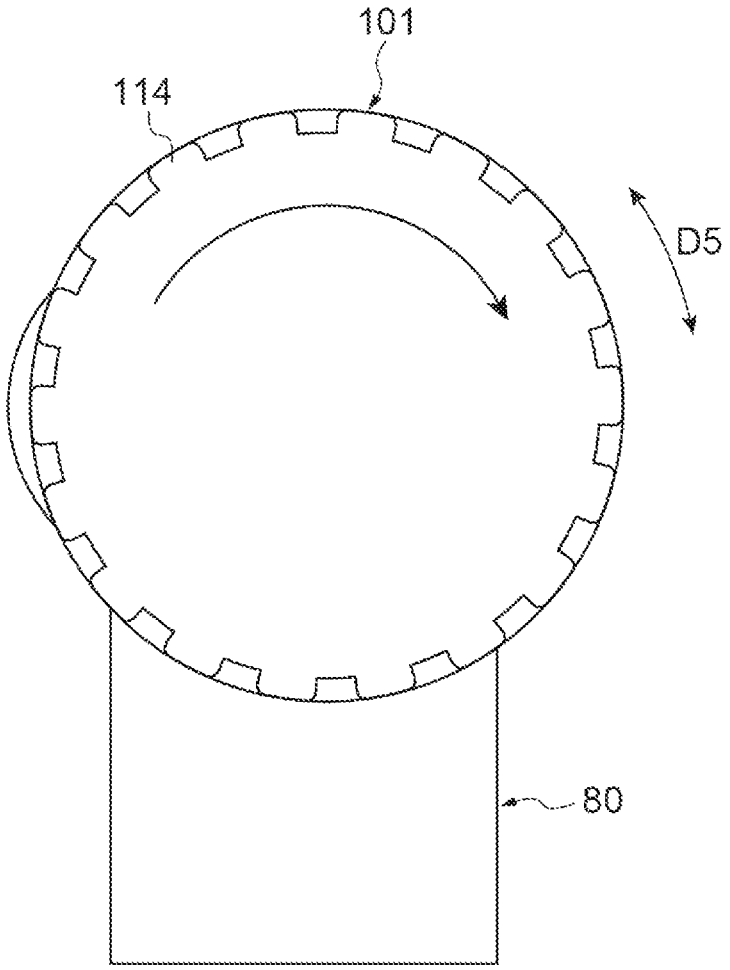
FIG. 14 is a side view of the example lubricant replacement case, schematically illustrating a rotation of the guiding support to the outer shell.
Figure 15:
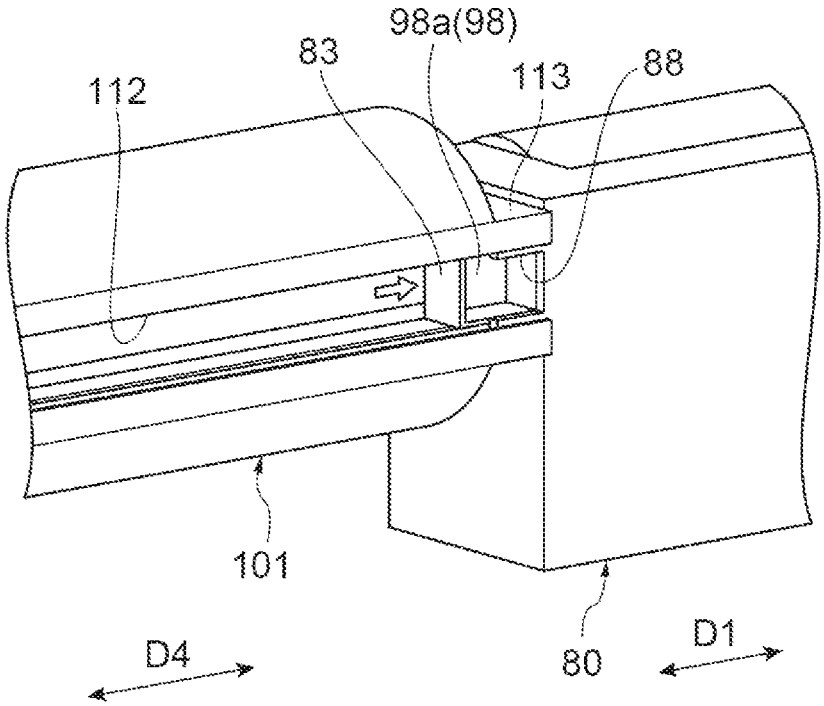
FIG. 15 is a perspective view of a portion of the lubricant replacement case illustrated adjacent a portion of a lubricant application device in an insertion operation of an unused lubricant unit.

An operation of drawing out the lubricant unit 83 from the lubricant application device 80 using the example lubricant replacement case 101 will be described with reference to FIGS. 12 to 15. FIG. 12 is a perspective view illustrating a retrieval of a used lubricant unit. FIG. 13 is a perspective view for describing a retrieval of the used lubricant unit. FIG. 14 is a side view illustrating a state where the guiding support is rotated relative to the outer shell. FIG. 15 is a perspective view illustrating an insertion of an unused lubricant unit.

Initially, the unused lubricant units 83 are accommodated in the storage compartments 103*b* of the lubricant replacement case 101, and no lubricant unit 83 is accommodated in the storage compartment 103*a* (cf. FIGS. 9 and 10). In the lubricant replacement case 101, the lubricant unit 83 is positioned in each of the storage compartments 103*b* so that the grasping portion 97 is located at a distal end opposite the opening 111 in the longitudinal direction D4. In addition, in the lubricant replacement case 101, the guiding support 104 is positioned relative to the outer shell 105 so that the storage compartment 103*a* in which the lubricant unit 83 is not accommodated is exposed from the opening 111 and the slit 112 of the outer shell 105.

Next, as illustrated in FIG. 12, the position guide 113 of the lubricant replacement case 101 is fitted onto the apparatus side position guide 88 of the housing 82 of the lubricant application device 80 associated with one of the plurality of image carriers 20 (for example, the image carrier 20M). Accordingly, the opening 111 of the lubricant replacement case 101 is positioned adjacent to the lubricant compartment 86 and the opening 87 of the lubricant application device 80, and the longitudinal direction D1 of the lubricant application device 80 and the longitudinal direction D4 of the lubricant replacement case 101 are linearly aligned with each other.

Next, as illustrated in FIGS. 12 and 13, the used lubricant unit 83 accommodated in the lubricant application device 80 may be drawn into the lubricant replacement case 101 via the recess 97*a* of the grasping portion 97, for example, by inserting a finger into the recess 97*a*. Then, when the finger or the like hooked into the recess 97*a* is moved along the slit 112 in the longitudinal direction D4, the used lubricant unit 83 is transferred from the lubricant application device 80 to be accommodated in the storage compartment 103*a* of the lubricant replacement case 101, through the opening 87 of the lubricant application device 80 and the opening 111 of the lubricant replacement case 101. Accordingly, the used lubricant unit 83 is retrieved from the lubricant application device 80.

Next, as illustrated in FIG. 14, the rotational operation portion 114 is operated to rotate the guiding support 104 in the rotational direction D5 relative to the outer shell 105. Then, the unused lubricant unit 83 to be inserted into the lubricant application device 80 is exposed from the opening 111 and the slit 112 of the outer shell 105. Namely, the rotational position of the guiding support 104 relative to the outer shell 105 is positioned so that the storage compartment 103*b* in which the unused lubricant unit 83 is accommodated is exposed from the opening 111 and the slit 112 of the outer shell 105.

Next, as illustrated in FIG. 15, the unused lubricant unit 83 exposed from the slit 112 may be drawn into the lubricant application device 80 via the recess 97*a* of the grasping portion 97, for example, by inserting a finger into the recess 97*a*. When the finger or the like hooked into the recess 97*a* is moved along the slit 112 in the longitudinal direction D4, the unused lubricant unit 83 accommodated in the storage compartment 103*b* of the lubricant replacement case 101 is inserted into the lubricant application device 80 through the opening 111 of the lubricant replacement case 101 and the opening 87 of the lubricant application device 80. Accordingly, the unused lubricant unit 83 is set into the lubricant application device 80, so that the storage compartment 103 that is exposed to the opening 111 and the slit 112 is empty.

Next, the lubricant replacement case 101 is removed from the lubricant application device 80, and the position guide 113 of the lubricant replacement case 101 is fitted onto the apparatus side position guide 88 of the housing 82 of the lubricant application device 80 associated with one of the remaining image carriers 20 (for example, the image carrier 20Y), for which the lubricant unit 83 has not been replaced. Then, in a similar manner described above, the used lubricant unit 83 accommodated in the lubricant application device 80 of the image carrier 20Y is retrieved into the empty storage compartment 103 of the lubricant replacement case 101, the guiding support 104 is rotated in the rotational direction D5 relative to the outer shell 105, and the unused lubricant unit 83 is inserted and set into the lubricant application device 80 of the image carrier 20Y. A similar procedure may be performed on each of the lubricant application devices 80 associated with the image carriers 20, so that the replacement of all the lubricant units 83 of the image forming apparatus 1 is completed.

When the replacement of the lubricant units 83 is completed, the storage compartment 103 that is exposed to the opening 111 and the slit 112 is empty, and all the lubricant units 83 retrieved into the lubricant replacement case 101 are covered with the outer shell 105. For this reason, even when the lubricant replacement case 101 that accommodates the retrieved lubricant units 83 is conveyed as it is, toner, lubricant abrasive powder, or the like adhering to the retrieved lubricant units 83 can be prevented or inhibited from scattering from the lubricant replacement case 101.

As described above, since the example lubricant replacement case 101 includes the plurality of storage compartments 103, the used lubricant unit 83 can be retrieved from the image forming apparatus 1, and the unused lubricant unit 83 can be inserted into the image forming apparatus 1.

In addition, the guiding support 104 forms the plurality of storage compartments 103 extending in the longitudinal direction D4, and the outer shell 105 forms the opening 111 and the slit 112 to slide the lubricant unit 83 into one of the plurality of storage compartments 103 in the longitudinal direction D4. Consequently, the lubricant unit 83 can be replaced while minimizing exposure of the lubricant unit 83. Accordingly, toner, lubricant abrasive powder, or the like adhering to the lubricant unit 83 can be prevented from scattering from the lubricant replacement case 101 when the lubricant unit 83 is replaced.

In addition, since the plurality of storage compartments 103 formed in the guiding support 104 are arranged in the rotational direction D5, the guiding support 104 can be rotated relative to the outer shell 105 to switch more easily between a position to retrieve the used lubricant unit 83 from the image forming apparatus 1 and a position to insert the unused lubricant unit 83 into the image forming apparatus 1.

FIGS. 16 to 19 illustrate another example lubricant replacement case 101A. With reference to FIGS. 16 to 19, the example lubricant replacement case 101A is a case to replace the lubricant unit 83 for the lubricant application device 80 of an image forming apparatus to form a monochromatic image. The lubricant replacement case 101A includes a housing 102A that includes a guiding support 104A forming two storage compartments 103 and an outer shell 105A covering the guiding support 104A. A housing 102A is formed in a substantially rectangular columnar shape. Each of the two storage compartments 103 extends in a longitudinal direction D7. The two storage compartments 103 may be isolated from each other, or may at least in part communicate with each other.

The two storage compartments 103 includes one storage compartment (first storage compartment) 103*a* for the used lubricant unit 83 to be retrieved from the image forming apparatus, and one storage compartment (second storage compartment) 103*b* for the unused lubricant unit 83 to be inserted into the image forming apparatus. For example, the unused lubricant unit 83 to be inserted into the image forming apparatus is accommodated in the storage compartment 103*b*.

The guiding support 104A is formed in a substantially rectangular columnar shape extending in the longitudinal direction D7, and the outer shell 105A is formed in a substantially rectangular cylindrical shape extending in the longitudinal direction D7. Then, the two storage compartments 103 are arranged in a linear direction D8, and the outer shell 105A is coupled with the guiding support 104A so as to be slidable in the linear direction D8. Accordingly, the outer shell 105A is movable in an arrangement direction of the two storage compartments 103 relative to the guiding support 104A.

The outer shell 105A includes a side cover 109A extending in a rectangular cylindrical shape and covering a side portion of the guiding support 104A, and an end cover 110A covering an end of the side cover 109A in the longitudinal direction D7. The end cover 110A forms an opening 111A to slide the lubricant unit 83 into one of the two storage compartments 103 in the longitudinal direction D7. The side cover 109A forms a slit 112A extending in the longitudinal direction D7, to slide the lubricant unit 83 into one of the two storage compartments 103 in the longitudinal direction D7. The slit 112A is adjacent to the opening 111A in the longitudinal direction D7, and is connected to the opening 111A. When the guiding support 104A slides in the linear direction D8 relative to the outer shell 105A, the opening 111A formed in the end cover 110A, the slit 112A formed in the side cover 109A, and one of the two storage compartments 103 can be aligned with each other.

Each of the two storage compartments 103 is open from the guiding support 104A in a direction orthogonal to the longitudinal direction D7 so that one of the two storage compartments 103 is exposed from the slit 112A of the outer shell 105A. In addition, each of the two storage compartments 103 is open from the guiding support 104A to one end in the longitudinal direction D7 so that one of the two storage compartments 103 is exposed from the opening 111A of the outer shell 105A.

The end cover 110A of the outer shell 105A includes a position guide 113A. The position guide 113A positions the opening 111A adjacent to the lubricant compartment 86 and the opening 87 of the lubricant application device 80 to move at least one lubricant unit 83 between the lubricant replacement case 101A and the image forming apparatus in the longitudinal direction D7. The position guide 113A protrudes from the end cover 110A in the longitudinal direction D7 to fit onto the apparatus side position guide 88 of the lubricant application device 80. The position guide 113A is formed to surround, for example, at least a part of the opening 111A.

The outer shell 105A forms an operation window 118 extending in the linear direction D8, to slide the guiding support 104A in the linear direction D8 relative to the outer shell 105A. The operation window 118 is formed at a position that is separated from the two storage compartments 103. The guiding support 104A forms an operation recess 119 to slide the guiding support 104A in the linear direction D8 relative to the outer shell 105A. At least a part of the operation recess 119 is exposed from the operation window 118 at any position along the entire region of sliding of the guiding support 104A relative to the outer shell 105A, in the linear direction D8.

An operation of drawing out the lubricant unit 83 from the lubricant application device 80 of the image forming apparatus to form a monochromatic image using the example lubricant replacement case 101A will be described.

Figure 16:
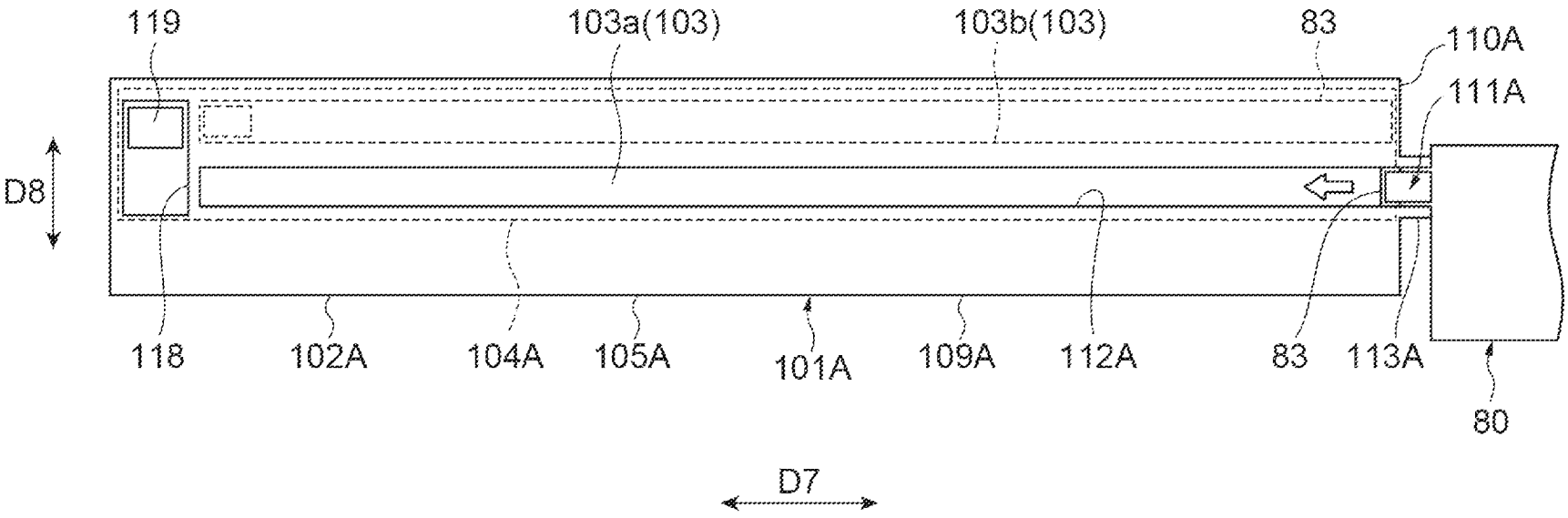
FIG. 16 is a front view of another example lubricant replacement case, illustrated in a first operational state.
Figure 17:
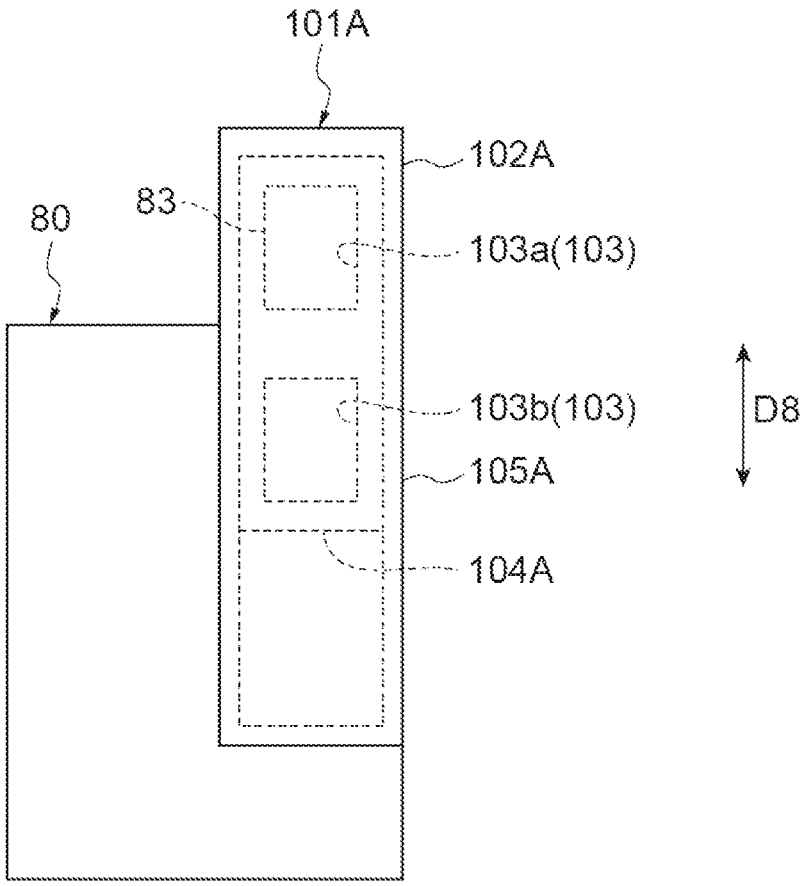
FIG. 17 is a side view of the lubricant replacement case illustrated in FIG. 16.

Initially, with reference to FIGS. 16 and 17, the unused lubricant unit 83 is accommodated in the second storage compartment 103*b* of the lubricant replacement case 101A, and the first storage compartment 103*a* is empty. In the lubricant replacement case 101A, the guiding support 104A is positioned relative to the outer shell 105A so that the first storage compartment 103*a* in which no lubricant unit 83 is accommodated is exposed from the opening 111A and the slit 112A of the outer shell 105A.

Next, the position guide 113A of the lubricant replacement case 101A is fitted onto the apparatus side position guide 88 of the housing 82 of the lubricant application device 80. Then, when a finger or the like is hooked into the recess 97*a* of the grasping portion 97 of the used lubricant unit 83 accommodated in the lubricant application device 80, and the finger or the like hooked into the recess 97*a* may move along the slit 112A in the longitudinal direction D7, to transfer the used lubricant unit 83 from the lubricant application device 80 to be accommodated in the storage compartment 103*a* of the lubricant replacement case 101A through the opening 87 of the lubricant application device 80 and the opening 111A of the lubricant replacement case 101A. Accordingly, the used lubricant unit 83 is retrieved from the lubricant application device 80.

Figure 18:
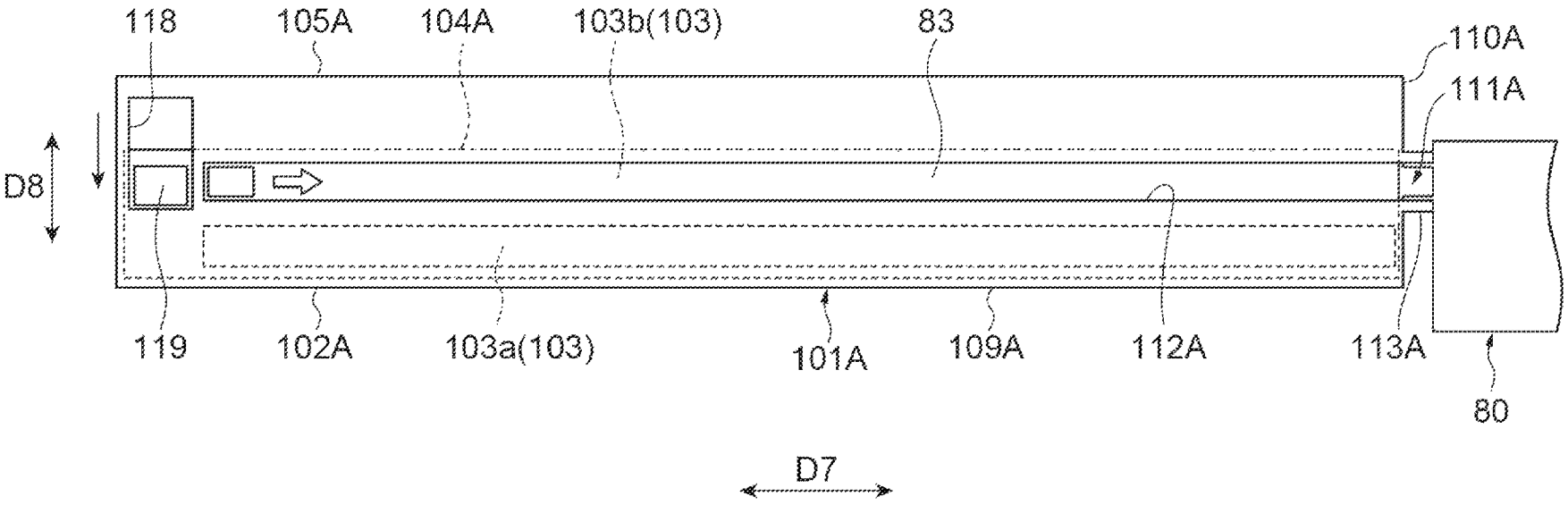
FIG. 18 is a front view of the lubricant replacement case of FIG. 16, illustrated in a second operational state.
Figure 19:
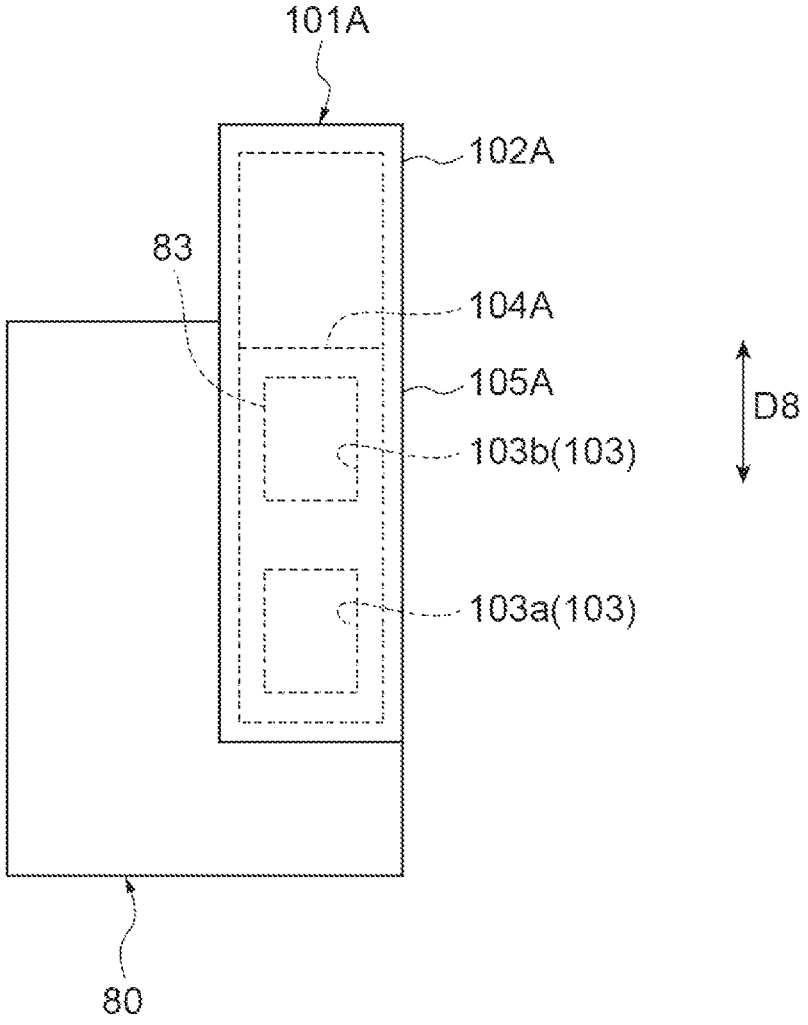
FIG. 19 is a side view of the lubricant replacement case illustrated in FIG. 18.

Next, as illustrated in FIGS. 18 and 19, when a finger or the like is hooked into the operation recess 119 from the operation window 118, and the finger or the like hooked into the operation recess 119 moves along the operation window 118 in the linear direction D8, the guiding support 104A slides in the linear direction D8 relative to the outer shell 105A. Then, the unused lubricant unit 83 to be inserted into the lubricant application device 80 is exposed from the opening 111A and the slit 112A of the outer shell 105A. Additionally, when the finger or the like is hooked into the recess 97*a* of the grasping portion 97 of the unused lubricant unit 83 exposed from the slit 112A, and the finger or the like hooked into the recess 97*a* moves along the slit 112A in the longitudinal direction D7, to insert the unused lubricant unit 83 from the storage compartment 103*b* of the lubricant replacement case 101A into the lubricant application device 80 through the opening 111A of the lubricant replacement case 101A and the opening 87 of the lubricant application device 80. Accordingly, the unused lubricant unit 83 is set in the lubricant application device 80. In addition, no lubricant unit is accommodated in the storage compartment 103 that is exposed to the opening 111A and the slit 112A. Accordingly, the replacement of the lubricant units 83 is completed.

As described above, in the lubricant replacement case 101A of the example, since the two storage compartments 103 formed in the guiding support 104A are arranged in the linear direction D8, the guiding support 104A is slidable in the linear direction D8 relative to the outer shell 105A to switch between a position to retrieve the used lubricant unit 83 from the image forming apparatus and a position to insert the unused lubricant unit 83 into the image forming apparatus.

It should be appreciated that all the aspects, advantages, and features described in the specification are not necessarily achieved by or included in any one specific example described. Namely, although various examples have been described in the specification, the arrangements and details can be changed in other examples.

Figure 20:
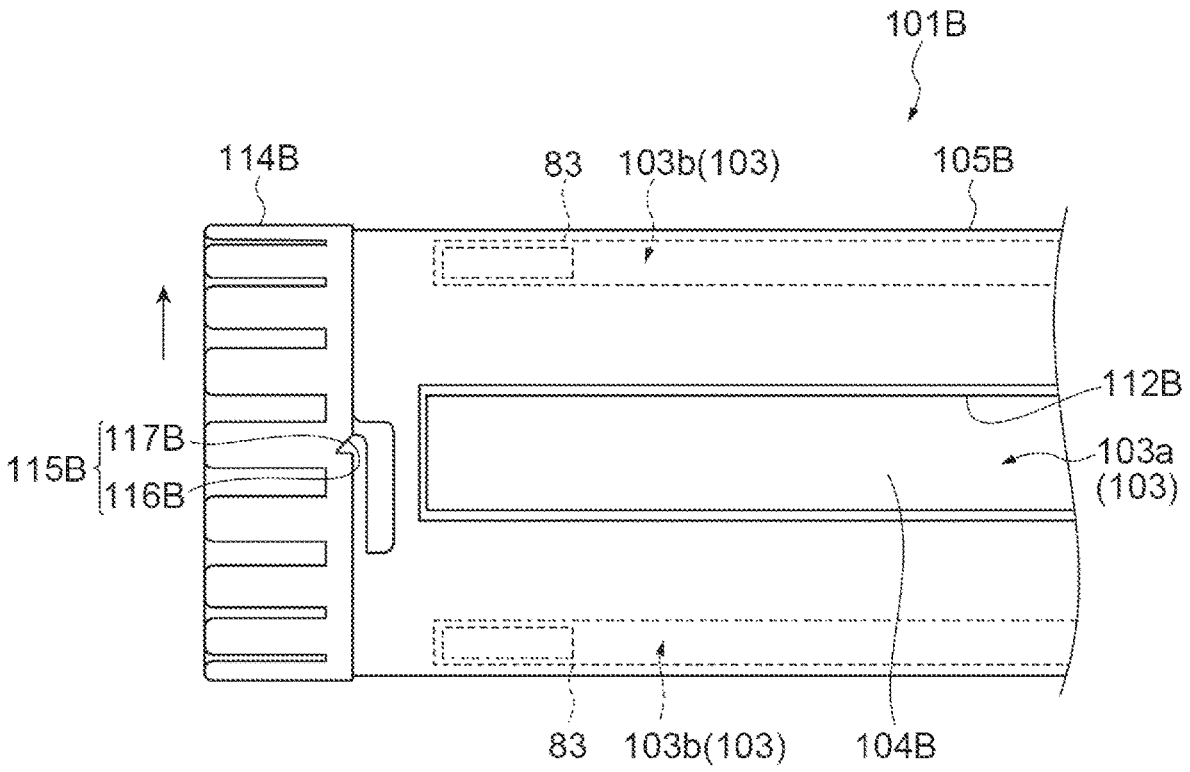
FIG. 20 is a partial front view illustrating another example lubricant replacement case.

For example, the outer shell may be coupled with the guiding support to rotate in a first direction relative to the guiding support, and to prevent a rotation of the outer shell in a second direction opposite the first direction. FIG. 20 is a front view illustrating a part of a lubricant replacement case of another example. A click stop coupling 115B of a lubricant replacement case 101B illustrated in FIG. 20 includes a recess 116B for each of the plurality of storage compartments 103 and a biased projection 117B to releasably fit into the recess 116B. The recess 116B is formed in, for example, a rotational operation portion 114B of a guiding support 104B, and the biased projection 117B is formed in, for example, a side cover 109B of an outer shell 105B. The recess 116B and the biased projection 117B are inclined in the first direction to allow rotation in the first direction, but are not inclined in the second direction to prevent rotation in the second direction opposite the first direction.

For example, no slit may be provided as long as the lubricant unit is slidable relative to the lubricant replacement case. For example, the lubricant replacement case may include a sliding device to slide the lubricant unit into one of the plurality of storage compartments, instead of the slit. The sliding device may be, for example, an electric device such as a motor to slide the lubricant unit. In addition, the lubricant replacement case may have openings at opposite ends in the longitudinal direction instead of the slit, and may push or pull the lubricant unit from one opening to replace the lubricant unit of the image forming apparatus through the other opening.

It is to be understood that not all aspects, advantages and features described herein may necessarily be achieved by, or included in, any one particular example. Indeed, having described and illustrated various examples herein, it should be apparent that other examples may be modified in arrangement and detail is omitted.

The invention claimed is:

1. A lubricant replacement case for an image forming apparatus, the lubricant replacement case comprising:

a housing including a plurality of storage compartments to accommodate at least one lubricant unit, wherein the plurality of storage compartments include at least one storage compartment for unused lubricant to be inserted into the image forming apparatus and at least one storage compartment for used lubricant to be retrieved from the image forming apparatus, wherein the housing includes a guiding support forming the plurality of storage compartments and an end forming an opening to slide a lubricant unit into one of the plurality of storage compartments in the longitudinal direction, wherein the housing includes an end cover forming the opening and an outer shell to cover the guiding support, wherein the outer shell forms a slit extending in the longitudinal direction at a position that is adjacent to the opening of the end cover.

2. The lubricant replacement case of claim 1, wherein the plurality of storage compartments extend in a longitudinal direction.

3. The lubricant replacement case of claim 2, wherein each of the plurality of storage compartments of the guiding support includes a guiding rail to limit a movement of an accommodated lubricant unit in a transverse direction orthogonal to the longitudinal direction.

4. The lubricant replacement case of claim 2,
wherein the plurality of storage compartments are arranged in an arrangement direction, and
wherein the guiding support is movable relative to the end cover in the arrangement direction, to align the opening with any one of the plurality of storage compartments.

5. The lubricant replacement case of claim 4, wherein the guiding support is coupled to the end cover by a click stop coupling to position the end cover so that the opening is aligned with any one of the plurality of storage compartments, wherein the click stop mechanism includes a recess for each of the plurality of storage compartments and a biased projection to releasably fit into the recess.

6. The lubricant replacement case of according to claim 1,
wherein the guiding support is rotatably coupled with the outer shell, and
wherein the plurality of storage compartments are arranged in a rotational direction of the guiding support relative to the outer shell.

7. The lubricant replacement case of claim 6, wherein the guiding support is coupled with the outer shell to rotate in a first direction relative to the outer shell, and to prevent a rotation of the guiding support in a second direction opposite the first direction.

8. The lubricant replacement case of claim 1,
wherein the plurality of storage compartments are arranged in a linear direction, and
wherein the guiding support is slidably coupled with the outer shell.

9. A lubricant replacement case for an image forming apparatus, the lubricant replacement case comprising:
a housing including a plurality of storage compartments to accommodate at least one lubricant unit, wherein the housing has an opening adjacent to one of the plurality of storage compartments to accommodate the at least one lubricant unit, wherein the housing includes an end cover forming the opening and an outer shell to cover a guiding support, wherein the outer shell forms a slit extending in the longitudinal direction at a position adjacent to the opening of the end cover.

10. The lubricant replacement case of claim 9, wherein the plurality of storage compartments include a first storage compartment to receive a used lubricant unit from the image forming apparatus, and a second storage compartment to accommodate a replacement lubricant unit to be inserted into the image forming apparatus.

11. The lubricant replacement case of claim 10, wherein the plurality of storage compartments include one or more additional storage compartments, wherein each of the one or more additional storage compartments accommodates an additional replacement lubricant unit.

12. The lubricant replacement case of claim 9,
wherein the lubricant replacement case accommodates the at least one lubricant unit, and
wherein each of the at least one lubricant unit includes:
a solid lubricant; and
a frame that supports the solid lubricant, wherein the frame includes a grasping portion to slide the lubricant unit along the slit.

13. The lubricant replacement case of claim 12,
wherein each of the at least one lubricant unit includes:
a support disposed between the solid lubricant and the frame, wherein the support is biased away from the frame, and
wherein each of the plurality of storage compartments of the lubricant replacement case includes a guiding rail to set the support at a fixed position relative to the frame of the lubricant unit accommodated.

14. The lubricant replacement case of claim 9,
wherein the housing extends in a longitudinal direction,
wherein the opening is located at a longitudinal end of the housing, and
wherein the longitudinal end of the housing includes a position guide to position the opening adjacent to a lubricant compartment of the image forming apparatus so as to move the at least one lubricant unit between the lubricant replacement case and the image forming apparatus in the longitudinal direction.

15. The lubricant replacement case of claim 9,
wherein the guiding support is rotatably coupled with the outer shell, and
wherein the plurality of storage compartments are arranged in a rotational direction of the guiding support relative to the outer shell.

16. The lubricant replacement case of claim 15, wherein the guiding support is coupled with the outer shell to rotate in a first direction relative to the outer shell, and to prevent a rotation of the guiding support in a second direction opposite the first direction.

17. The lubricant replacement case of claim 9,
wherein the plurality of storage compartments are arranged in a linear direction, and wherein the guiding support is slidably coupled with the outer shell.

18. The lubricant replacement case of claim 9, wherein the guiding support is coupled to the end cover by a click stop coupling to position the end cover so that the opening is aligned with any one of the plurality of storage compartments. , wherein the click stop mechanism includes a recess for each of the plurality of storage compartments and a biased projection to releasably fit into the recess.

19. The lubricant replacement case of claim 18, wherein the click stop mechanism includes a recess for each of the plurality of storage compartments and a biased projection to releasably fit into the recess.

20. The lubricant replacement case of claim 9, wherein the guiding support forms the plurality of storage compartments.

* * * * *